US012173703B2

(12) United States Patent
Chen et al.

(10) Patent No.: US 12,173,703 B2
(45) Date of Patent: Dec. 24, 2024

(54) PERISTALTIC PUMP

(71) Applicant: Alcon Inc., Fribourg (CH)

(72) Inventors: Brad Yin Chen, Mission Viejo, CA (US); Eric Lee, Irvine, CA (US); Gary P. Sorensen, Mission Viejo, CA (US); Vincent A. Baxter, Temecula, CA (US)

(73) Assignee: Alcon Inc., Fribourg (CH)

( * ) Notice: Subject to any disclaimer, the term of this patent is extended or adjusted under 35 U.S.C. 154(b) by 0 days.

(21) Appl. No.: 18/500,956

(22) Filed: Nov. 2, 2023

(65) Prior Publication Data

US 2024/0068465 A1 Feb. 29, 2024

Related U.S. Application Data

(62) Division of application No. 16/780,945, filed on Feb. 4, 2020, now abandoned.

(60) Provisional application No. 62/802,743, filed on Feb. 8, 2019.

(51) Int. Cl.

| | |
|---|---|
| ***F04B 43/14*** | (2006.01) |
| ***F04B 43/12*** | (2006.01) |
| *F04B 43/02* | (2006.01) |

(52) U.S. Cl.

CPC ..... *F04B 43/1261* (2013.01); *F04B 43/1276* (2013.01); *F04B 43/14* (2013.01); *F04B 43/021* (2013.01)

(58) Field of Classification Search

CPC ..... F04B 43/1269; F04B 43/14; F04B 43/1276; F04B 43/1261; F04B 42/1253; F04B 43/00; F04B 43/08; F04B 43/02; F04B 43/021; F04B 45/04; F04B 45/08; F04B 45/10

USPC ..... 137/625.46, 625.47

See application file for complete search history.

(56) References Cited

U.S. PATENT DOCUMENTS

| | | | | |
|---|---|---|---|---|
| 2,920,577 | A * | 1/1960 | Schaurte | F04B 43/14 417/477.7 |
| 2013/0287613 | A1* | 10/2013 | Gould | F04B 43/0054 417/476 |
| 2017/0081625 | A1* | 3/2017 | Wikswo | F04B 43/0045 |

* cited by examiner

*Primary Examiner* — Philip E Stimpert
*Assistant Examiner* — Dnyanesh G Kasture
(74) *Attorney, Agent, or Firm* — Patterson + Sheridan, LLP

(57) ABSTRACT

Certain aspects of the present disclosure provide a surgical cassette configured to engage a first plurality of rollers of a first roller head. The cassette comprises a face coupled to a first substrate, the face being at a first angle with respect to the first roller head's axis of rotation and a wall of first substrate being at a second angle with respect to the axis of rotation, wherein the first angle is different from the second angle. The cassette also comprises a first sheet positioned on the wall's surface, wherein the first sheet and the wall form first one or more pump segments configured to engage the first plurality of rollers in a position where force applied by each one of the first plurality of rollers on the first one or more pump segments has a direction that is not parallel to the first roller head's axis of rotation.

8 Claims, 15 Drawing Sheets

PERISTALTIC PUMP

CROSS-REFERENCE TO RELATED APPLICATION(S)

This application is a divisional of U.S. Non-Provisional patent application Ser. No. 16/780,945, filed Feb. 4, 2020, which claims priority to and benefit of U.S. Provisional Patent Application No. 62/802,743, filed Feb. 8, 2019. The entire contents of each of which are incorporated by reference herein in their entirety

BACKGROUND

Aspects of the present disclosure generally relate to peristaltic pumps. Peristaltic pumps may be used in many different applications including aspiration and/or irrigation of material (e.g., fluids) during surgical operations, such as ophthalmic surgeries. Peristaltic pumps may operate by compressing a length of tubing to move a fluid in the tubing or squeezing a molded flow channel between an elastomeric sheet and a rigid substrate to move a fluid between the elastomeric sheet and the rigid substrate. Rotating roller heads applied against the tubing or elastomeric sheet may be used for compressing the tubing or elastomeric sheet.

BRIEF SUMMARY

The present disclosure relates to a surgical cassette having one or more peristaltic pumps. Certain aspects provide a surgical cassette configured to engage a first plurality of rollers of a first roller head. The surgical cassette comprises a face coupled to a first pump substrate, the face being at a first angle with respect to an axis of rotation of the first roller head and a wall of the first pump substrate being at a second angle with respect to the axis of rotation of the first plurality of rollers, wherein the first angle is different from the second angle. The cassette also comprises a first sheet positioned on a surface of the wall, wherein the first sheet and the wall form first one or more pump segments configured to engage the first plurality of rollers in a position where force applied by each one of the first plurality of rollers on the first one or more pump segments has a direction that is not parallel to the axis of rotation of the first roller head.

Certain aspects provide a surgical cassette configured to engage a first plurality of rollers of a first roller head and a second plurality of rollers of a second roller head, comprising first one or more pump segments configured to engage the first plurality of rollers, and second one or more pump segments configured to engage the second plurality of rollers.

Certain aspects provide a surgical system comprising a first motor configured to rotate a first plurality rollers of a first roller head, wherein the first plurality of rollers are engaged by first one or more pump segments of a surgical cassette and a second motor configured to rotate a second plurality of rollers of a second roller head, wherein the second plurality of rollers are engaged by second one or more pump segments of the surgical cassette.

The following description and the related drawings set forth in detail certain illustrative features of one or more embodiments.

BRIEF DESCRIPTION OF THE DRAWINGS

The appended figures depict certain aspects of the one or more embodiments and are therefore not to be considered limiting of the scope of this disclosure.

To facilitate understanding, identical reference numerals have been used, where possible, to designate identical elements that are common to the drawings. It is contemplated that elements and features of one embodiment may be beneficially incorporated in other embodiments without further recitation.

DETAILED DESCRIPTION

Incorporation by Reference

U.S. Pat. No. 8,790,096 ("'096 patent") entitled "Peristaltic Pump and Cassette." by Gary P. Sorensen, filed Apr. 7, 2010 is hereby incorporated by reference in its entirety as though fully and completely set forth herein.

Aspects of the present disclosure relate generally to peristaltic pumps. Certain aspects provide a surgical cassette comprising a non-coplanar peristaltic pump. Certain aspects provide a dual pump surgical cassette. In certain aspects, a dual pump surgical cassette with one coplanar peristaltic pump and one non-coplanar peristaltic pump is provided. In certain aspects, a dual pump surgical cassette with two coplanar peristaltic pumps is provided. Also, certain aspects provide a surgical cassette having a non-coplanar pump with a rotary valve function.

Figure 1A:
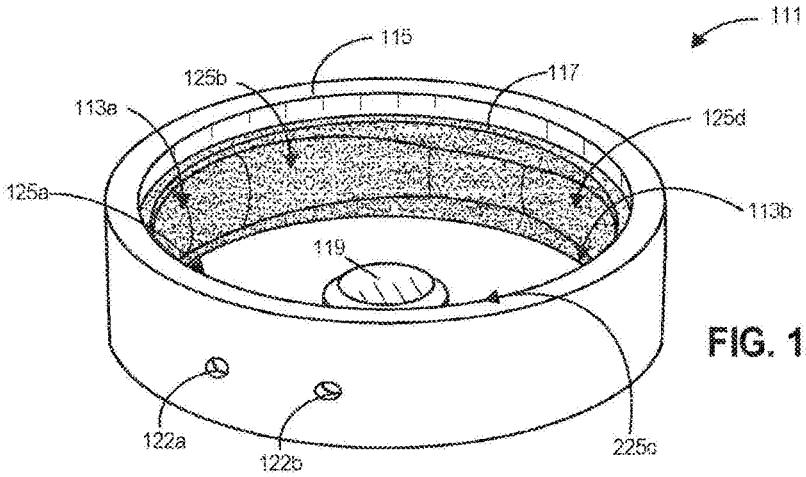
FIG. 1A illustrates an example non-coplanar pump, in accordance with certain aspects.

FIG. 1A illustrates exemplary pump 111 comprising a ring-shaped pump sheet 117 as well as a cup-shaped pump substrate 115 that are coupled together to form a pump with two non-coplanar pump segments 113*a* and 113*b*. More specifically, pump segments 113 are formed between sheet 117 and substrate 115. Note that FIG. 1A only partially shows pump segment 113*a* while pump segment 113*b* is not shown but merely pointed to. However, pump segments 113*a* and 113*b* are shown and described in more detail in relation to FIGS. 1C-1E. Pump 111 is used as part of surgical cassette 100 of FIG. 1B. More specifically, pump segments 113 of pump 111 are used by cassette 100 to provide aspiration (or suction) and/or infusion (or irrigation) of fluids for a surgical console. As further described below, pump segments 113*a* and 113*b* are non-coplanar with respect to the face 105 of cassette 100, because, unlike the pump segments shown in the '096 patent, pump segments 113 are not on the same plane as face 105.

Pump segments 113*a* and 113*b* operate similar to the pump segments described in the '096 patent in that a fluid can be pumped through pump segments 113*a* and 113*b* when rollers of a roller head engage pump segments 113*a* and 113*b*. The two pump segments 113 produce additional flow (e.g., approximately twice the flow for two segments as opposed to one) as compared to a cassette having only one pump segment engaging a roller head. Note that in aspects where there are two or more pump segments used, each pump segment forms separate fluid paths such that fluid entering one pump segment does not enter the second pump segment.

Ring-shaped sheet 117 may be bonded or mechanically attached to cup-shaped substrate 115. For example, sheet 117 may be coupled to substrate 115 through the use of an adhesive, heat fusion, mechanical crimping, rivets, etc. Sheet 117 may be made of a flexible and moldable material, such as silicone rubber or thermoplastic elastomer. Substrate 115 may be made of a material that is rigid with respect to sheet 117, such as a rigid thermoplastic, and may be made by any suitable method, such as machining or injection molding.

As shown, substrate 115 comprises ports 122*a* and 122*b*, one of which is an inlet port and the other is an outlet port. Although not shown, substrate 115 comprises two additional ports that are symmetrically located with respect to ports 122*a-b*. Ports 122 are aligned with or fluidly connected to inlet/outlet ports of cassette 100 of FIG. 1B. FIG. 1A also shows substrate 115 comprising an alignment guide 119 that is configured to be inserted into an opening of a roller head, as described in further detail below. Also, although two pump segments 113*a* and 113*b* are shown in FIG. 1A, in certain aspects, a sheet and a substrate may be coupled to form only one pump segment or more than two pump segments.

Figure 1B:
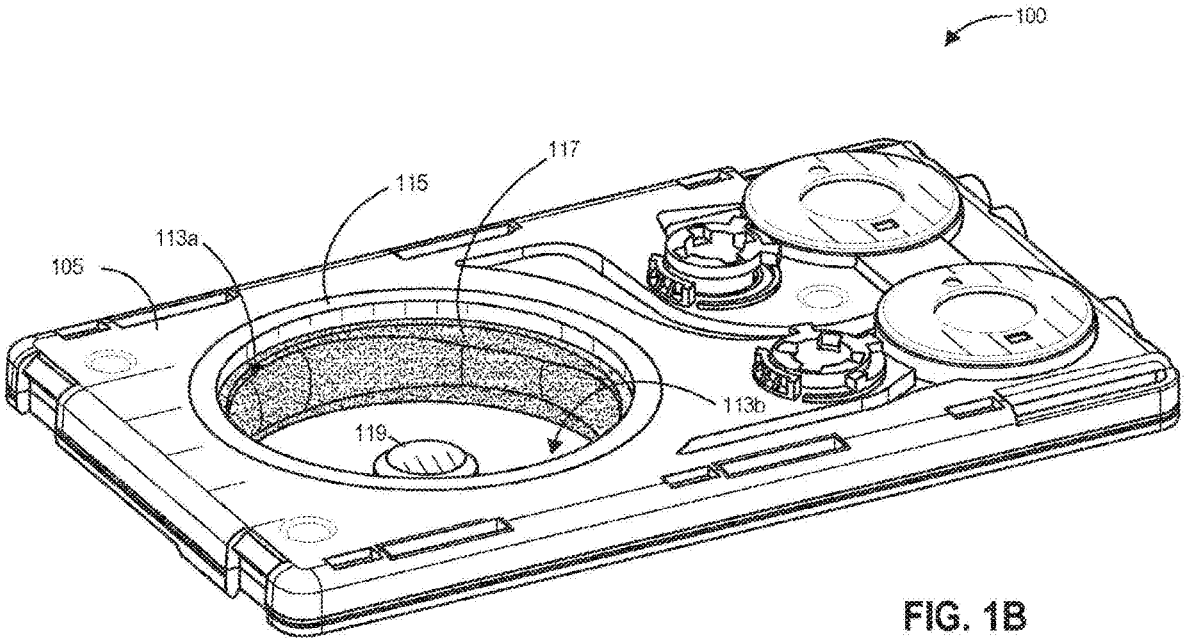
FIG. 1B illustrates the non-coplanar pump of FIG. 1A in a surgical cassette, in accordance with certain aspects.

FIG. 1B illustrates surgical cassette 100 comprising a cassette face 105 as well as pump 111. As described above, cassette 100 uses pump segments 113*a* and 113*b* to provide aspiration and/or infusion of fluids for a surgical console (e.g., an ophthalmic surgical console). Alignment guide 119 of substrate 115 is configured to be inserted into an opening of a roller head such that the rollers of the roller head are able to engage pump segments 113 for pumping a fluid through pump segments 113 and in and out of inlet/outlet ports 122. As shown, the cylindrical wall of substrate 117 are at an angle (e.g., 0 degrees) with respect to the axis of rotation of the roller head that is different than an angle (e.g., 90 degree) face 105 makes with the axis of rotation. Accordingly, in certain aspects, pump segments 113 may be referred to as being non-coplanar with respect to face 105 of cassette 100.

Note that, in certain aspects, cup-shaped substrate 115 and face 105 (or the body) of cassette 100 are manufactured as one piece. In certain other aspects, substrate 115 is manufactured separately but coupled to the body of cassette 105. In both cases, however, substrate 115 and face 105 may be referred to as being coupled to each other.

Figure 1C:
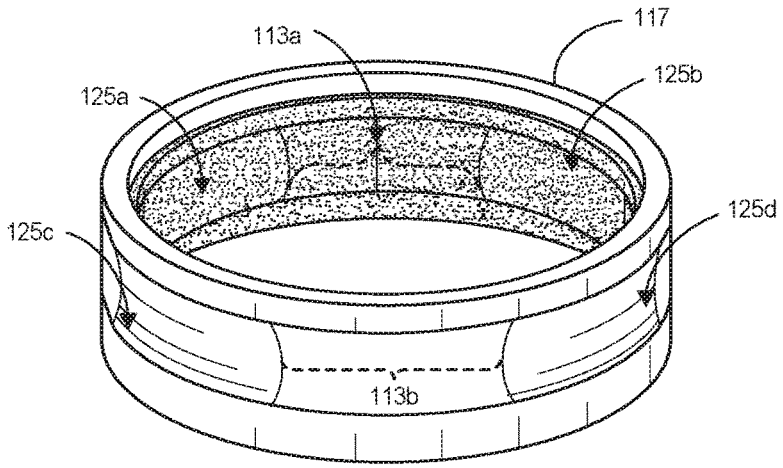
FIGS. 1C, 1D, 1E, and 1F illustrate different views of a ring-shaped sheet and a cup-shaped substrate of the non-coplanar pump of FIG. 1A, in accordance with certain aspects.
Figure 1D:
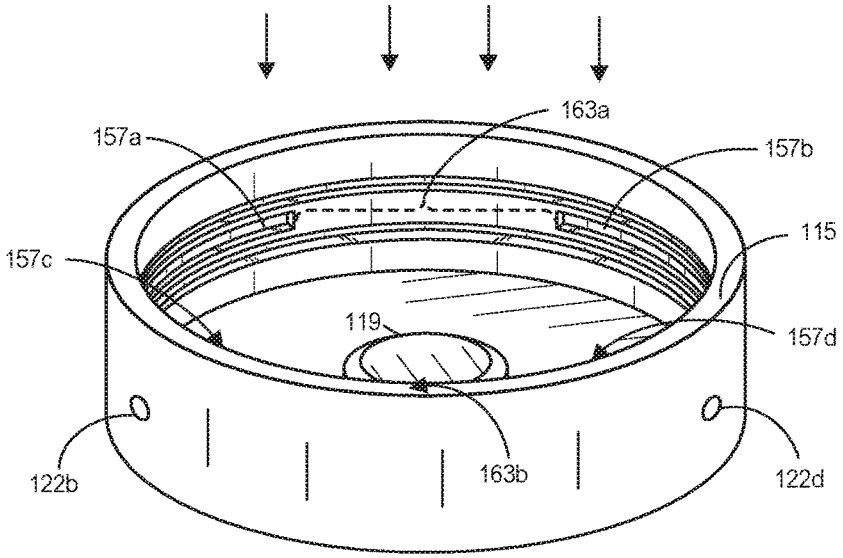

FIG. 1C illustrates example sheet 117 while FIG. 1D illustrates example substrate 115, which may be bonded or mechanically attached to sheet 117 to provide pump 111 of FIGS. 1A-1B. Sheet 117 includes pump segments 113*a* and 113*b* as well as transition regions 125*a*-125*d*. Substrate 115 comprises transition channels 157*a*-157*d* (although 157*c*-157*d* are not shown but only pointed to) as well as active regions 163*a*-163*b* (although 163*b* is not shown but only pointed to).

Once sheet 117 is bonded or attached to substrate 115, transition regions 125*a*-125*d* are overlaid on top of transition channels 157*a*-157*d*, respectively. Also, pump segments 113*a*-113*b* are overlaid on top of active regions 163*a*-163*b*, respectively. Substrate 115 also comprises ports 122*a-d* (although ports 122*a-c* are not shown) which allow for fluid to circulate in the area between sheet 117 and substrate 115.

Figure 1E:
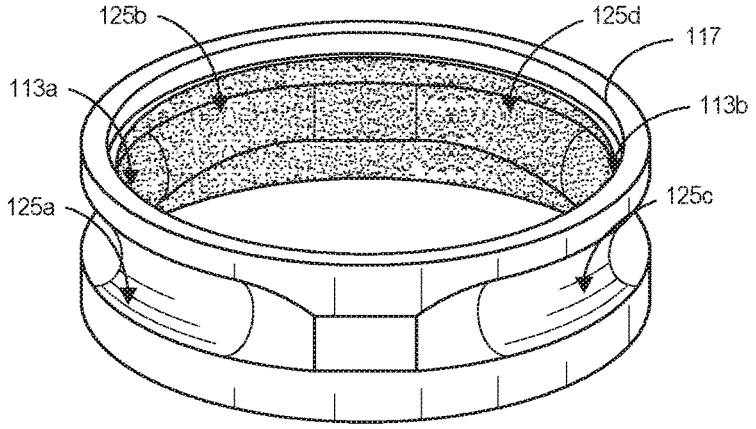
Figure 1F:
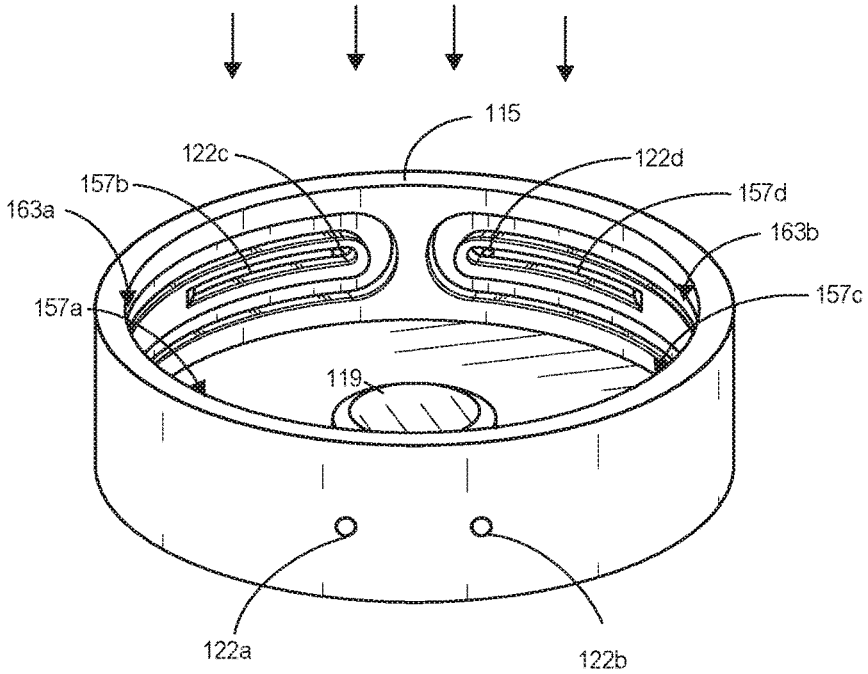

FIGS. 1E and 1F provide views of sheet 117 of FIG. 1C and substrate 115 of FIG. 1D, respectively, with a 90 degree counter clockwise rotation. As shown, sheet 117 comprises transition regions 125*b* and 125*d*, which are overlaid on top of transition channels 157*b* and 157*d*, respectively, as well as transition regions 125*a* and 125*c*, which are overlaid on top of transition channels 157*a* and 157*c* (not shown in this view), respectively. Pump segments 113*a*-113*b* are also overlaid on top of active regions 163*a*-163*b* respectively. Pump segments 113*a*-113*b*, also referred to as active pump segments, are engaged by rollers of a roller head.

Figure 2A:
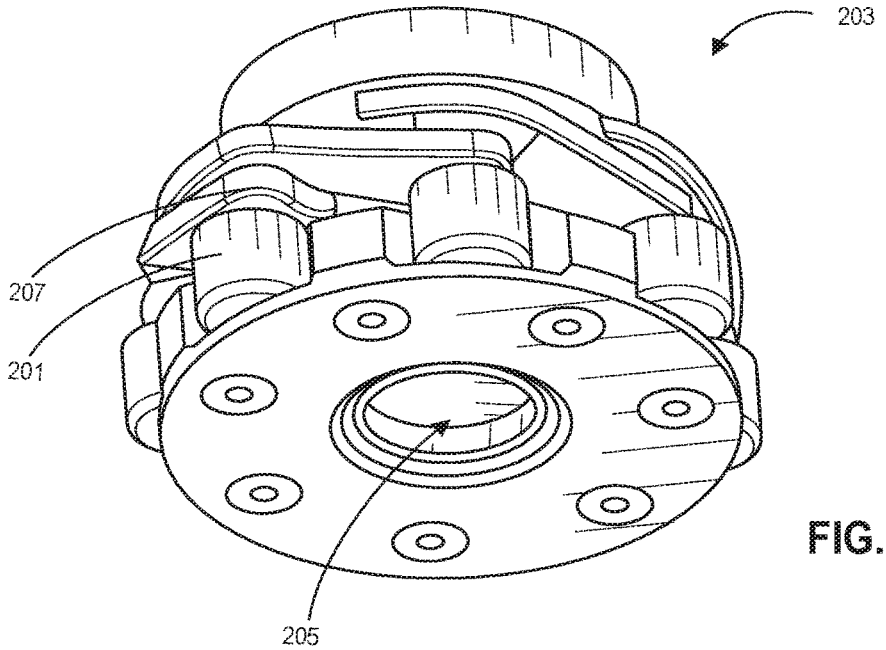
FIG. 2A illustrates an example roller head, in accordance with certain aspects.
Figure 2B:
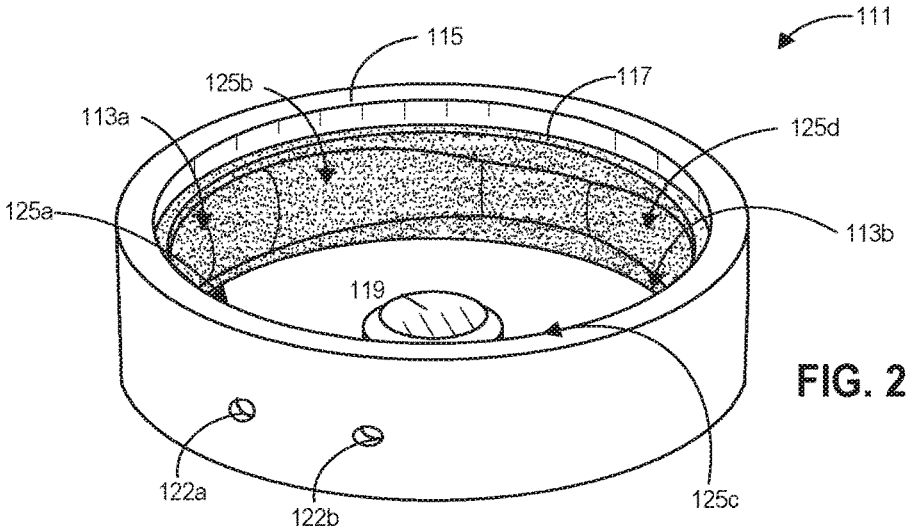
FIG. 2B illustrates the non-coplanar pump of FIG. 1A configured to be engaged by the roller head of FIG. 2A, in accordance with certain aspects.

FIGS. 2A and 2B illustrate a roller head 203 having rollers 201, which are configured to engage pump segments 113 of pump 111 when cassette 100 is received into a cassette receiving portion of a surgical console (not shown). In one example, roller head 203 may comprise seven rollers 201, although a larger or smaller number of rollers may also be used. Each roller 201 is coupled to a roller arm 207, which may be spring loaded in certain aspects. When cassette 100 is received into the cassette receiving portion of the surgical console, alignment guide 119 of pump 111 is inserted into an alignment guide opening 205 of roller head 203. Also, as cassette 100 is received into the cassette receiving portion of the surgical console, rollers 201 press sheet 117 against substrate 115. In areas where a roller 201 presses sheet 117 against substrate 115, such as pump segments 113, the space between sheet 117 and substrate 115 is reduced.

In certain aspects, the inner diameter of pump 111 is configured such that when alignment guide 119 is inserted into opening 205, the inside wall of substrate 115 apply a force to rollers 201 that is directed radially towards the axis of rotation of roller head 203. In such aspects, rollers 201 may be biased (e.g., spring-loaded) such that, in response to the force applied by the inside wall of substrate 115, a bias force is applied to rollers 201 in the opposite direction (i.e., opposite direction of the force applied by the inside walls of substrate 115). Accordingly, rollers 201 apply a force on sheet 117 resulting in a compression of sheet 117 against the inside wall of substrate 115. Such a configuration ensures that enough force is applied by rollers 201 to sheet 117 for pumping the fluids within pump 111.

In certain aspects, opening 205 is configured with a mechanism such that the insertion of alignment guide 119 causes rollers 201 to be radially expanded or pushed out against sheet 117 (e.g., pushed away from the axis of rotation of roller head 203). The radial expansion of rollers 201 exerts additional force on sheet 117. Similar to the configuration described above, this configuration also ensures that enough force is applied by rollers 201 to sheet 117 for pumping the fluids within pump 111. In certain aspects, such a mechanism may include the use of a tapered center alignment pin where the gradual increase in the diameter of opening 205 would radially expand rollers 201, which causes rollers 201 to press against sheet 117. In certain other aspects, each roller 201 may be linked to a cam such that when the cam is engaged, it causes a lateral movement of rollers 201. In such aspects, since rollers 201 are oriented radially, they all move radially outwards to apply pressure to sheet 117.

As rollers 201 rotate, a bolus of fluid may be moved between adjacent rollers. For example, as rollers 201 roll over and away from an inlet port (e.g., inlet port 122*b* or 122*c*), a fluid bolus may be pulled into pump segment 113*b* through the inlet port (because of a vacuum created by the roller pushing the fluid away from the inlet). As rollers 201 approach and roll over an exit or outlet port (e.g., outlet port 122*a* or 122*d*), a fluid bolus may travel through the outlet port. The operations of rollers 201 relating to how they engage pump segments 113 are similar to how the rollers in the '096 patent engage pump segments (e.g., as described in column 4, line 67 through column 6 line 2 of the '096 patent). As such, the details of such operations are only briefly discussed herein. For example, as rollers 201 engage pump segments 113, each roller may first roll over a transition region 125. As rollers 201 roll off of the transition region 125, rollers 201 may form an internal seal within a corresponding pump segment 113 by pressing the sheet 117 against substrate 115 at a seal point. The internal seal may move as a roller rolls over a pump segment 113. As the roller moves, fluid in front of the roller's motion may be pushed through the pump segment 113 resulting in fluid behind the roller's motion being pulled from the inlet (e.g., inlet 112*a*). The flow of a fluid within pump segments 113 is shown in FIG. 3.

Note that, as compared to the '096 patent with a planar pump, using a non-coplanar pump 111 in cassette 100 may reduce the normal force applied on face 105 of cassette 100 when the pump's segments are engaged. In certain cases, applying too much normal force on face 105 results in vibrations to the cassette body, which in turn may negatively impact the functionality of one or more pressure sensors in cassette 100. For example, one or more sensors may be used in cassette (e.g., on face 105) for sensing, for example, the inlet vacuum pressure or the outlet pressure of fluids. The sensors, in certain cases, may provide more accurate pressure measurements when there is less normal force applied to cassette 100 while a fluid is pumped through the cassette.

Pump 111 may also be referred to as a coaxial pump because the axis of rotation of roller head 203 and an axis at the center of alignment guide 119 and parallel to the walls of pump 111 are concentric. In other words, roller head 203's axis of rotation makes a 0 or 180 degree angle with the surface of the cylindrical wall of substrate 115 (e.g., the surface of the cylindrical wall of substrate 115 and roller head 203's axis of rotation are parallel).

Figure 3:
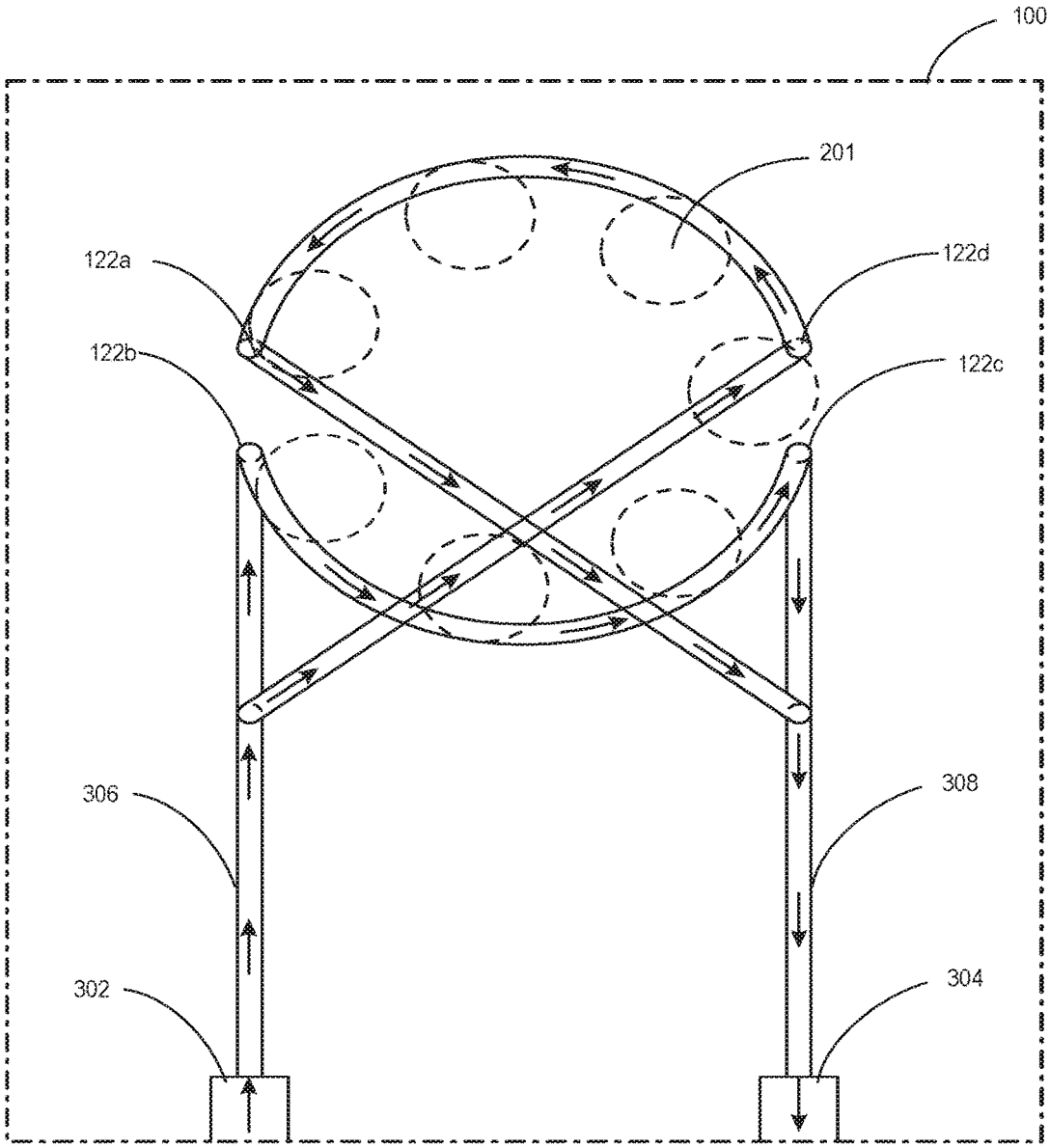
FIG. 3 illustrates an example fluidic path within the non-coplanar pump of FIG. 1A, in accordance with certain aspects.

FIG. 3 illustrates a fluid path within cassette 100. As shown, cassette 100 comprises an inlet 302, where a fluid enters cassette 100 and then is transported within an entry channel 306 that splits into two sub-entry channels, one for providing some of the fluid to inlet port 122*b* and another for providing the rest of the fluid to inlet port 122*d*. As rollers 201 rotate within the pump, the fluid entering inlet ports 122*b* and 122*d* is transported within the active pump segments 113 and subsequently ejected from outlet ports 122*a* and 122*c*. The fluid exiting from each of outlet ports 122*a* and 122*c* then merge together in exit channel 308 and are ejected from surgical cassette 100 through outlet 304.

Similar to the pump segments of the surgical cassette in the '096 patent, pump segments 113 of pump 111 described herein may be angularly spaced relative to the rollers 201 such that pulsations in the flow profile produced by the actions of the rollers 201 on one pump segment (e.g., segment 113*a*) may be out of phase with pulsations in the flow profile produced by the other pump segment (e.g., segment 113*b*).

Figure 4:
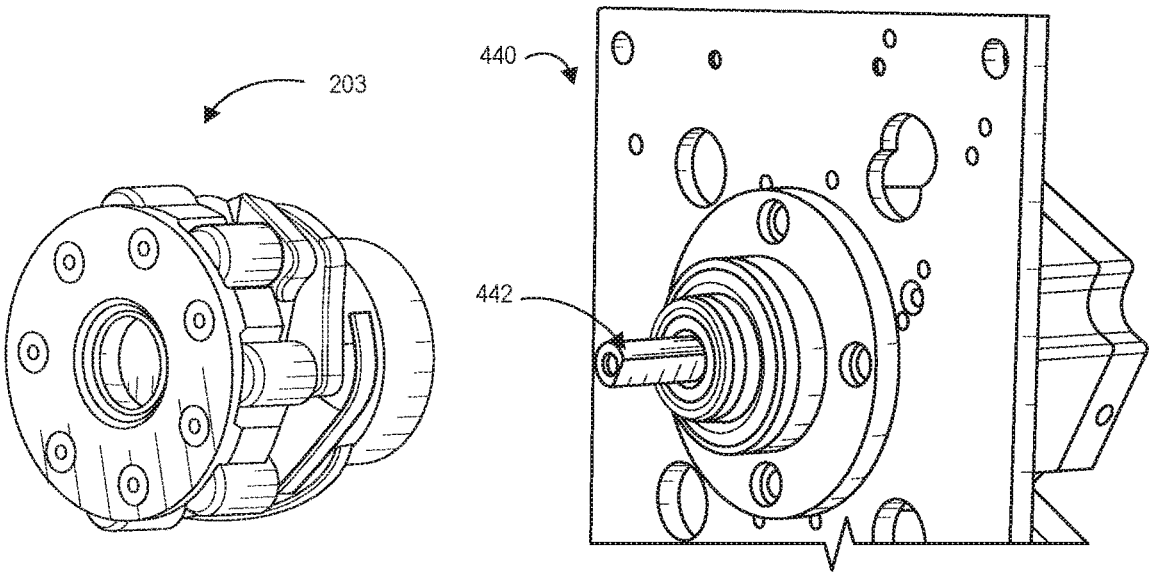
FIG. 4 illustrates an example assembly for rotating the roller head of FIG. 2A, in accordance with certain aspects.

FIG. 4 illustrates a shaft 442 extending out of an assembly 440, which may be coupled to an actuator or a motor for rotating shaft 442 around an axis of rotation parallel to shaft 442. Shaft is inserted into the back of roller head 203. As such, a rotation of shaft 442 causes a rotation of the rollers of roller head 203.

Figure 5A:
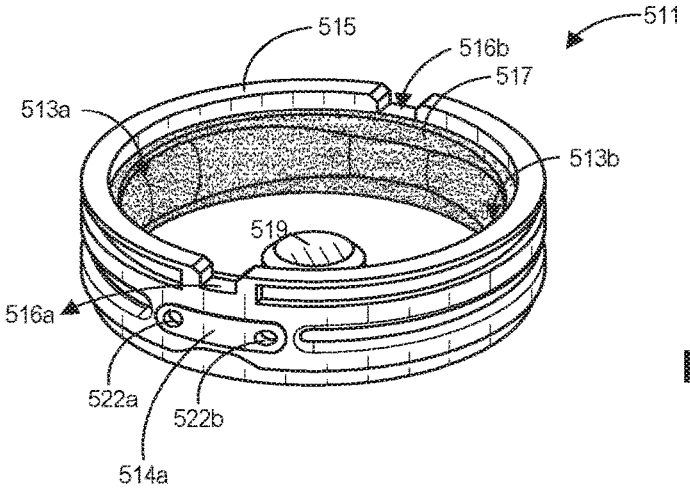
FIG. 5A illustrates an example non-coplanar pump configured to also function as a rotary valve, in accordance with certain aspects.

FIG. 5A illustrates an exemplary pump 511, which operates similar to pump 111 with the exception that pump 511 is configured to also function as a rotary valve. Rotating pump 511 allows for pump 511's inlet/outlet ports to be aligned with different fluidic inlets and outlets in different settings, as further described below.

As shown, pump 511 comprises a sheet 517 as well as a substrate 515 that are coupled together to define non-coplanar pump segments 513*a* and 513*b*, similar to pump segments 113*a* and 113*b* of pump 111 in FIG. 1A. Substrate 515 comprises notches 516, which are configured to engage with an actuator for the rotation of pump 511, as described in further detail below. As shown, substrate 515 also comprises ports 522*a* and 522*b*, one of which is an inlet port and the other is an outlet port. Gasket 514*a* is used for hermetically sealing ports 522*a* and 522*b*. Although not shown, substrate 515 comprises another gasket as well as two additional ports that are symmetrically located with respect to gasket 514*a* and ports 522*a-b* (i.e., the ports are located below notch 516*b*). FIG. 5A also shows substrate 515 comprising an alignment guide 519 that is configured to be inserted into an opening of roller head, such as roller head 203. In addition substrate 515 comprises grooves 532, which result in less surface contact between the outer wall of substrate 515 and the inner wall of a base (e.g., base 521 of FIG. 5B) during pump 511's rotation inside of the base.

Figure 5B:
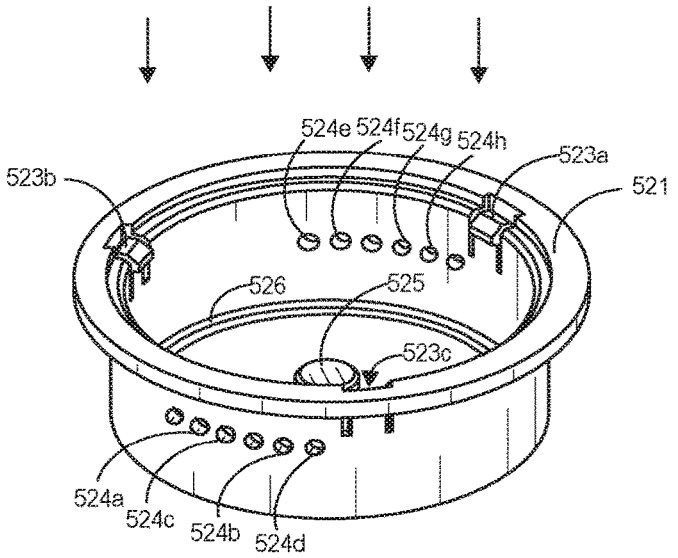
FIG. 5B shows an example cup-shaped base of a surgical cassette, in accordance with certain aspects.
Figure 5C:
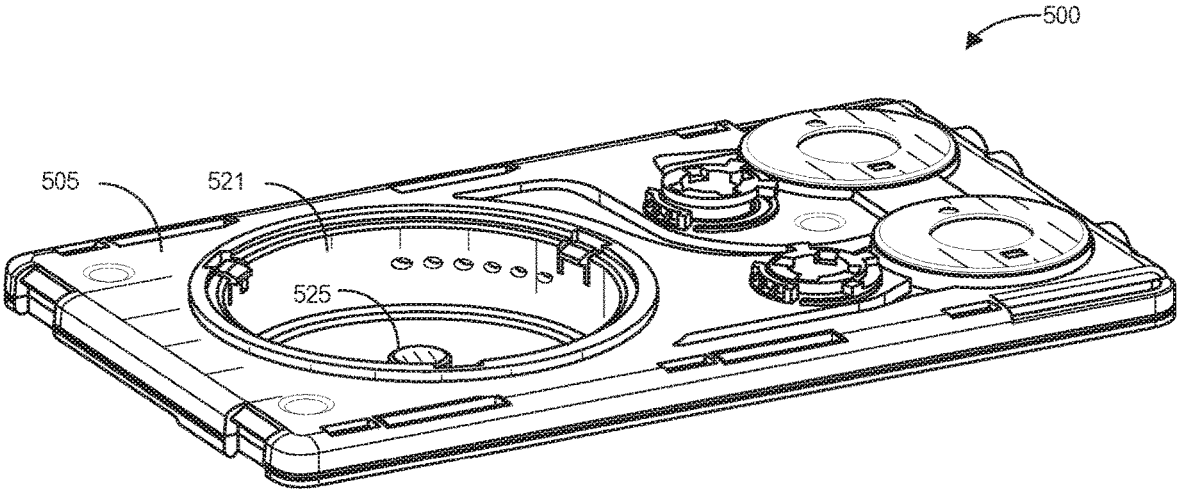
FIG. 5C illustrates the cup-shaped base of FIG. 5B as part of the body or face of a cassette, in accordance with certain aspects.

FIG. 5B shows an example cup-shaped base 521 of a surgical cassette 500 shown in FIG. 5C. Pump 511 is configured to be placed into and secured inside of base 521. For example, pump 511 may be secured to base 521 using latches 523. Base 521 comprises an alignment insert 525 that is inserted into the back of alignment guide 519 of substrate 515.

In addition, base 521 comprises a number of inlet/outlet ports 524 that are configured to be aligned with ports 122 of substrate 515. For example, ports 524*a* and 524*b* may be aligned with ports 522*a* and 522*b* while ports 524*f* and 524*h* may be aligned with the two additional ports of substrate 515 that are not shown in FIG. 5A. Ports 524 of base 521 are fluidly coupled to various fluidic inlets/outlets (e.g., fluidic inlet 302, fluidic outlet 304, etc.) of cassette 500. For example, some of ports 524 may be coupled to fluidic inlets/outlets associated with an aspiration probe. Some other ports 524 may be coupled to fluid inlets/outlets associated with an irrigation probe. As described above, pump 511 is capable of functioning as a rotary valve, such that in different settings, ports 522 of pump 511 may be aligned with different ports 524 of base 521. As a result, rotating pump 511 acts as a valve by selectively opening and closing different fluidic paths corresponding to the different ports 524.

To illustrate this with an example, in one setting, as described above, ports 522*a* and 522*b* may be aligned with ports 524*a* and 524*b*, which may be coupled to fluidic inlets/outlets associated with an aspiration probe. In another setting, a rotation of pump 511 by an actuator may align ports 522*a* and 522*b* with ports 524*c* and 524*d*, which may be coupled to fluidic inlets/outlets associated with an irrigation probe. In certain aspects, ports 524*a*-524*d* may be coupled to the same fluidic inlets/outlets. In such cases, pump 511 may frequently switch from a first setting, in which ports 522*a* and 522*b* are aligned with ports 524*a* and 524*b*, to a second setting, in which ports 522*a* and 522*b* are aligned with ports 524*c* and 524*d*, and back, in order to reduce the pulsation associated with the operation of pump 511.

FIG. 5C illustrates base 521 as part of the body or face 505 of cassette 500. Similar to in the '096 patent, cassette 500 uses pump segments to provide aspiration and/or infusion (i.e., irrigation) of a fluid for a surgical console (e.g., an ophthalmic surgical console). Alignment guide 519 of substrate 515 is configured to be inserted into an opening (e.g., opening 205 of roller head 203) of a roller head such that the rollers of the roller head are able to engage the pump segments for pumping a fluid flowing through the inlet/outlet ports.

Note that, in certain aspects, base 521 and face 505 (or the body) of cassette 500 are manufactured as one piece. In certain other aspects, base 521 is manufactured separately but coupled to the body of cassette 500. In both cases, however, base 521 and face 505 may be referred to as being coupled to each other.

Figure 5D:
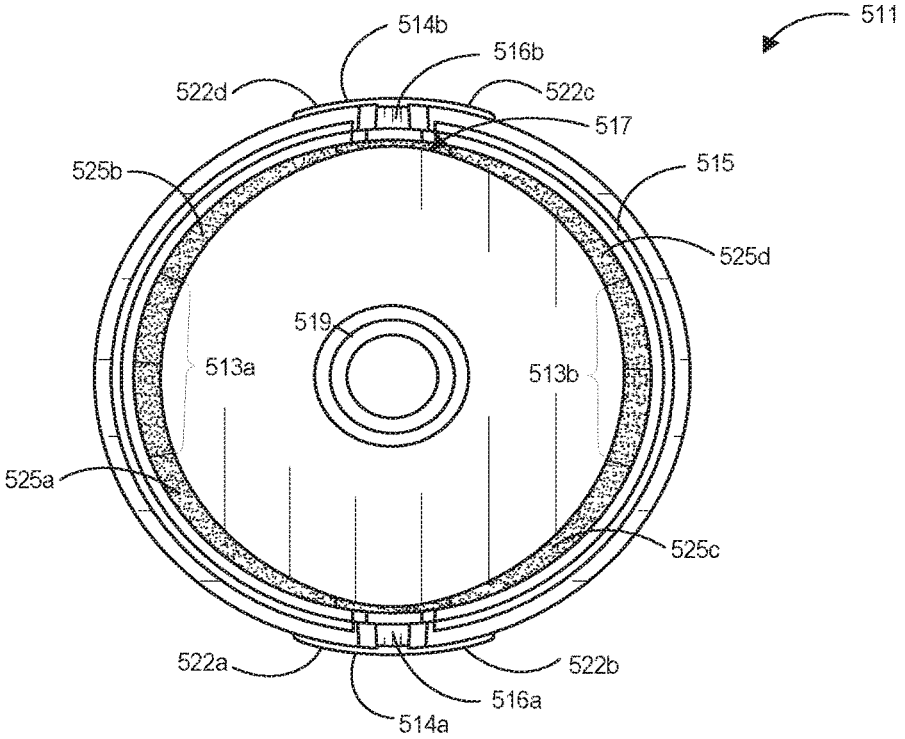
FIGS. 5D, 5E, and 5F illustrate different views of the non-coplanar pump of FIG. 5A and the cup-shaped based of FIG. 5B, in accordance with certain aspects.

FIG. 5D illustrates a top view of pump 511 including sheet 517 and substrate 515. As shown, substrate 515 comprises notches 516*a* and 516*b* as well as ports 522*a-d*, which are hermetically sealed by gaskets 514*a-b*. Substrate 515 also comprises alignment guide 519. Sheet 517 comprises pump segments 513*a*-513*b* and transition regions 525*a*-525*d*.

Figure 5E:
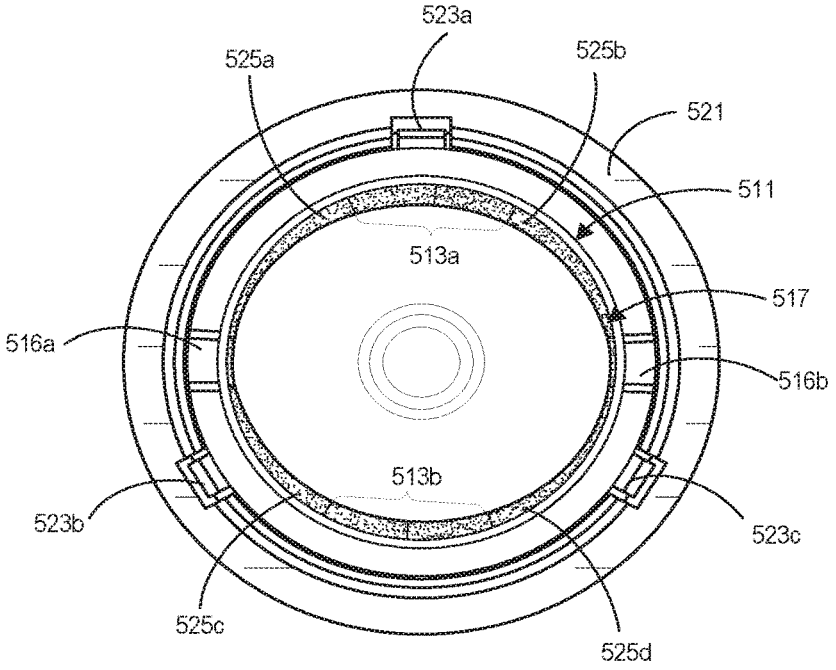

FIG. 5E illustrates a top view of pump 511 secured inside base 521. As shown, latches 523*a-c* are configured to latch on to pump 511 to ensure that pump 511 is not separated from surgical cassette 500.

Figure 5F:
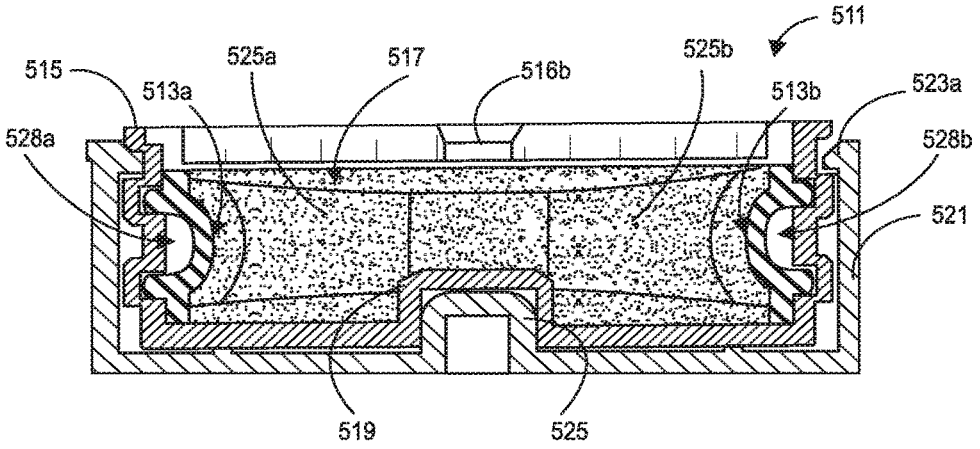

FIG. 5F illustrates a cross sectional view of pump 511 secured inside base 521. As shown, alignment insert 525 of base 521 is inserted into the back of alignment guide 519 of pump 511. In certain aspects, the outer diameter of alignment insert 525 and the inner diameter of alignment guide 519 are selected such that pump 511 is secured to base 521 based on the friction between alignment insert 525 and alignment guide 519 after alignment insert 525 is inserted into alignment guide 519. As shown, pump 511 is further secured inside of base 521 by a number of latches, including latch 523*a*. Fluids are able to be pumped through the space between sheet 117 and substrate 515 inside pump segment 513*a* and 513*b*. For example, fluids are transported in space 528*a* underneath pump segment 513*a* when pump segment 513*a* is engaged by rollers 201 of roller head 203. In areas where roller 201 presses sheet 517 against substrate 515, space 528*a* is reduced.

Figure 6:
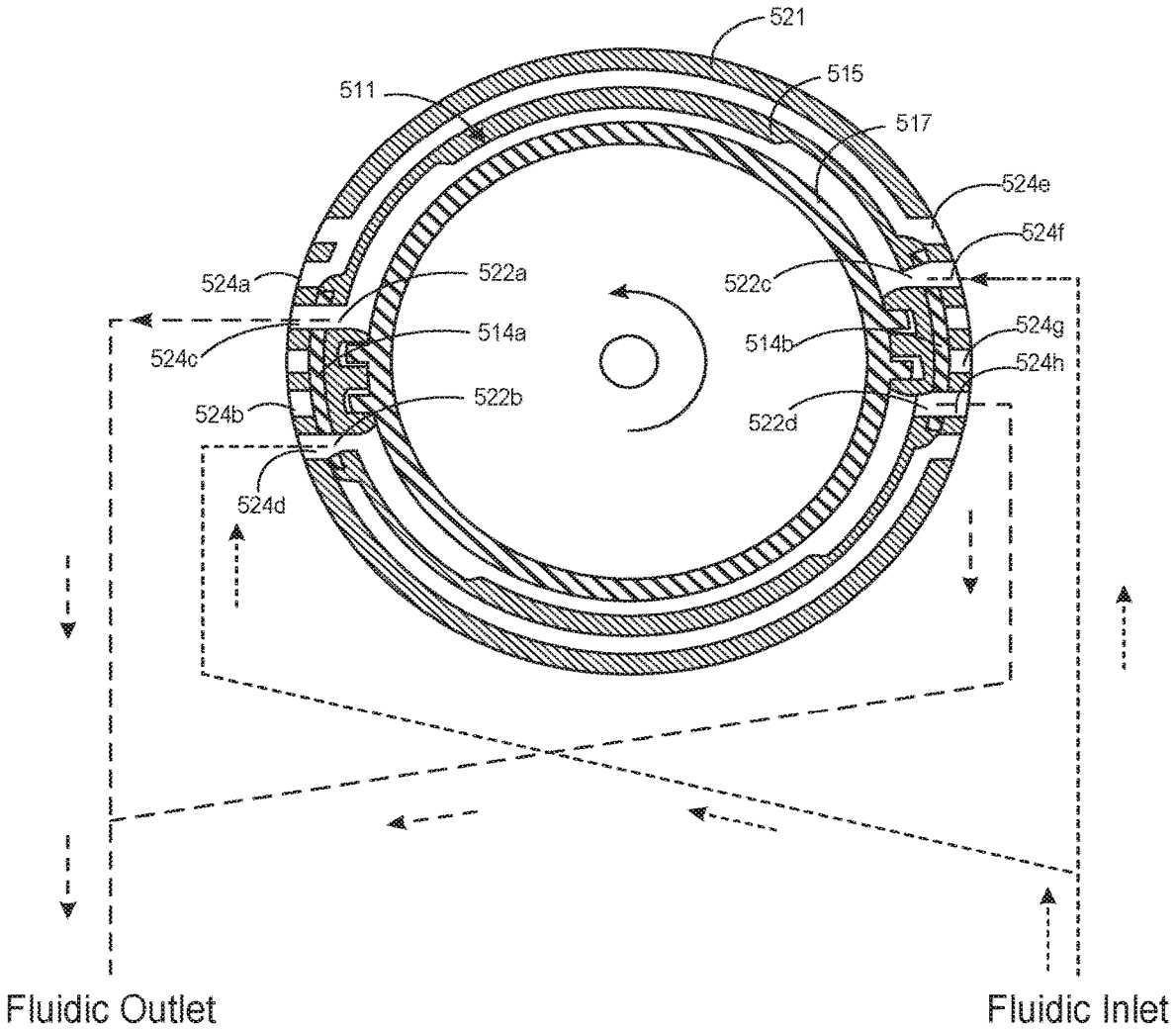
FIGS. 6 and 7 illustrate example fluidic paths within the non-coplanar pump of FIG. 5A and the cup-shaped based of FIG. 5B, in accordance with certain aspects.

FIG. 6 illustrates an example flow of fluid in and out of pump 511, configured to function as a rotary valve. As shown, pump 511 is placed within base 521 such that ports 522*a* and 522*b* of pump 511 are aligned with ports 524*c* and 524*d*, respectively, of base 521 while ports 522*d* and 522*c* of pump 511 are aligned with ports 524*f* and 524*h*. As shown, pump 511 is configured to be rotated within base 521, thereby, aligning ports 522*a* and 522*b* with ports other than 524*c* and 524*d*. As shown, a fluid enters from the fluidic inlet of the surgical cassette and enters pump 511 from inlet ports 524*f*/522*c* and inlet ports 524*d*/522*b*. The fluid is then pumped by rollers 201 and exits from outlet ports 124*h*/522*d* and outlet ports 524*a*/522*a*. The fluid exiting from each of outlet ports 124*h*/522*d* and outlet ports 524*c*/522*a* then merge together to exit from the fluidic outlet of the surgical cassette.

Figure 7:
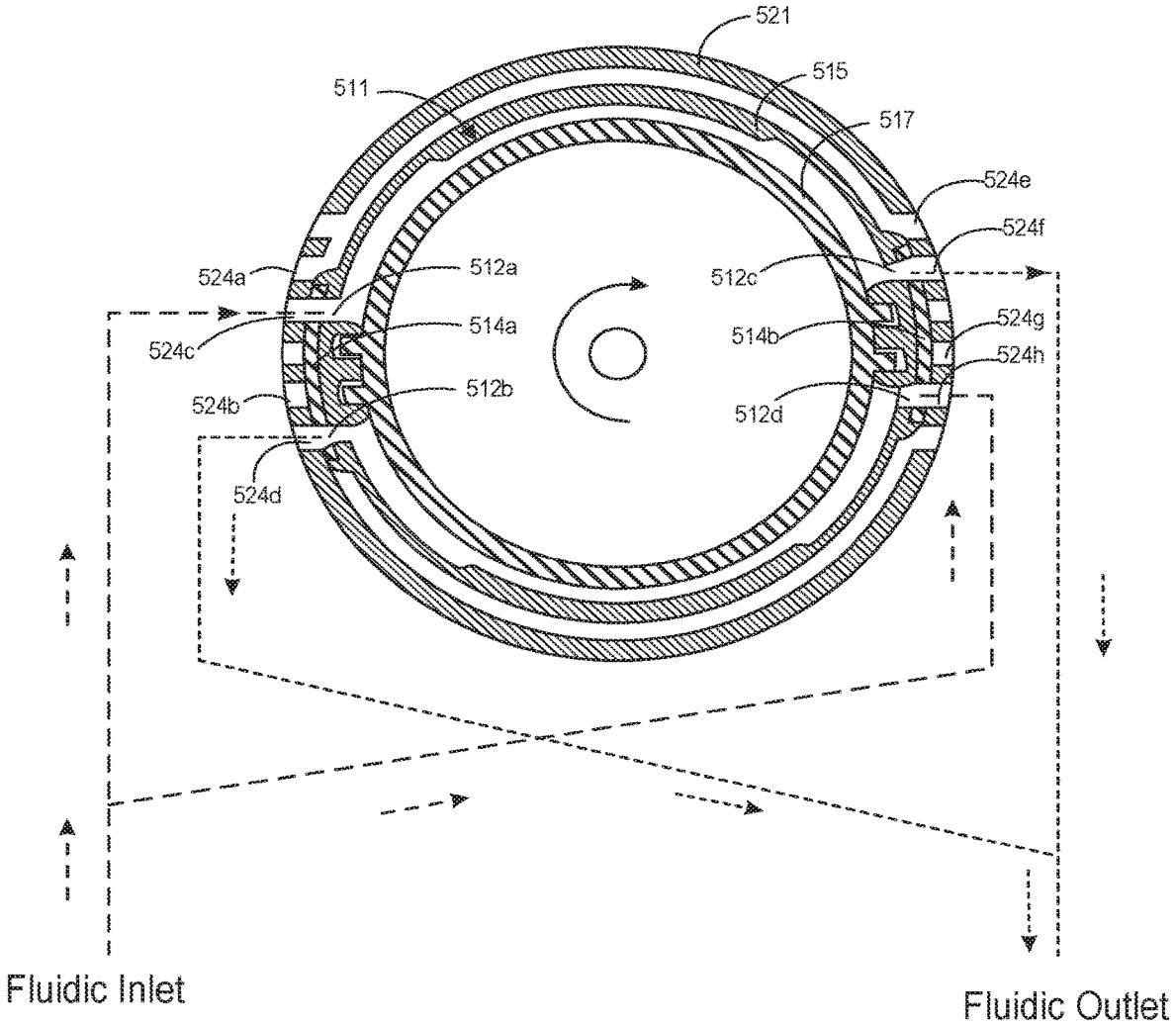

FIG. 7 illustrates another example flow of fluid in and out of pump 511. FIG. 7 is shown to illustrate that a port that is used as an inlet port in one use-case can be used as an outlet port in another use-case of pump 511. For example, FIG. 7 shows a fluid entering from the fluidic inlet of the surgical cassette and entering pump 511 from inlet ports 524*h*/522*d* and inlet ports 524*c*/522*a*. The fluid is then pumped by rollers 201 and exits from outlet ports 524*f*/522*c* and outlet ports 524*d*/522*b*. The fluid exiting from each of outlet ports 524*f*/522*c* and outlet ports 524*d*/522*b* then merge together to exit from the fluidic outlet of the surgical cassette.

Figure 8A:
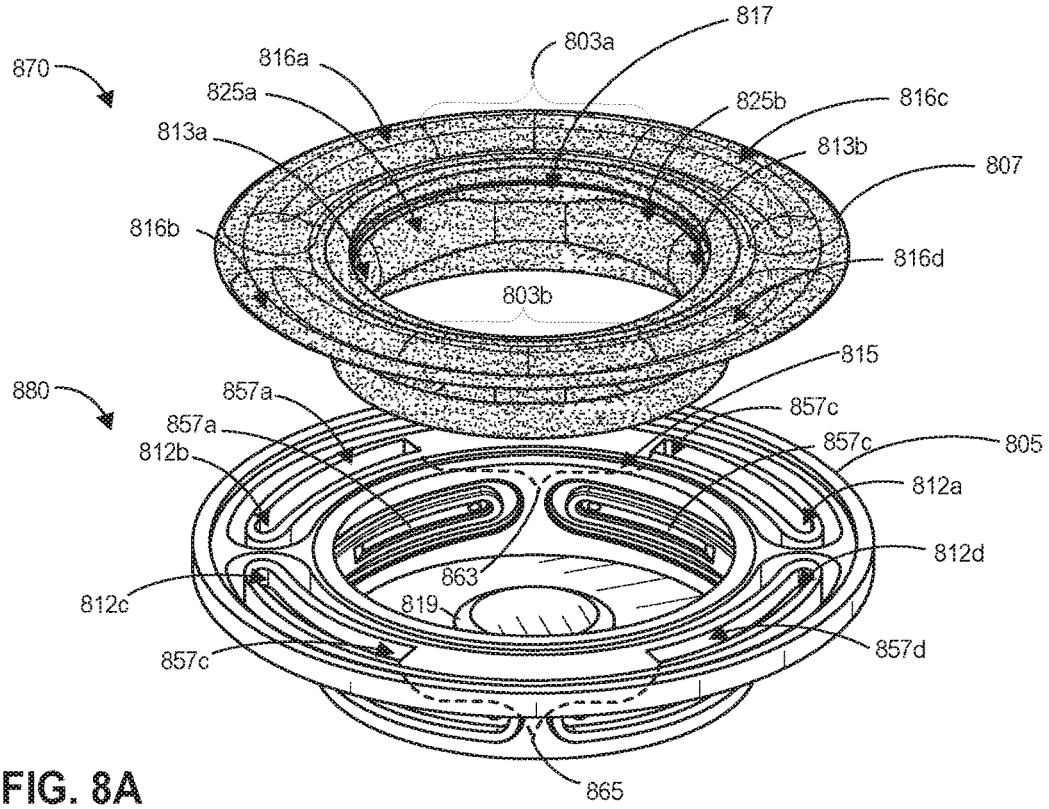
FIG. 8A illustrates a multi-pump sheet and a multi-pump substrate, in accordance with certain aspects.

FIG. 8A illustrates an example multi-pump sheet 870 as well as multi-pump substrate 880. As shown, multi-pump sheet 870 is a combination of sheet 817, similar to sheet 817 shown in FIGS. 2A-2C, as well as sheet 807, which is configured to be coplanar with or placed on the face (e.g., face 105/505) of a surgical cassette (e.g., cassette 100/500). Sheet 817 comprises active pump segments 813*a*-813*b* as well as transition regions 825*a*-825*b* (the other two transition regions are not shown). Sheet 807 comprises active pump segments 803*a*-803*b* as well as transition regions 816*a*-816*d*, which are similar to and operate similar to the pump segments and transition regions described in the '096 patent. In certain aspects, multi-pump sheet 870 is manufactured as one piece and, in certain other aspects, sheet 817 and sheet 807 are manufactured as separate pieces.

Multi-pump substrate 880 is a combination of cup-shaped substrate 815, similar to substrate 115 shown in FIGS. 2B-2D, as well as ring-shaped substrate 805, which is configured to be coplanar with the face a surgical cassette. In other words, roller head 203's axis of rotation makes a 90 degree angle with the surface of substrate 805 (e.g., the surface of substrate 805 is perpendicular to roller head 203's axis of rotation).

Substrate 815 comprises transition channels 857*a*-857*b* (857*c*-857*d* are not shown) as well as two active regions (e.g., not shown but similar to 863*a*-863*b*). Substrate 815 also comprises an alignment guide 819. Substrate 805's surface comprises active regions 863 and 865 as well as transition channels 857*a*-857*d*. Although not shown, the surface of substrate 805 also comprises inlet/outlet ports 822*a*-822*d*. Multi-pump substrate 880, in certain aspects, is part of the body of a surgical cassette. In other words, in such aspects, multi-pump substrate 880 is manufactured as part of the cassette body. In certain other aspects, multi-pump substrate 880 is a component that is separate from the body of the surgical cassette but it is configured to be coupled to the body of the cassette.

Multi-pump sheet 870 may be bonded or mechanically attached to multi-pump substrate 880. For example, multi-pump sheet 870 may be coupled to multi-pump substrate 880 through the use of an adhesive, heat fusion, mechanical crimping, rivets, etc. Multi-pump sheet 870 may be made of a flexible and moldable material, such as silicone rubber or thermoplastic elastomer. Multi-pump substrate 880 may be made of a material that is rigid with respect to multi-pump sheet 870, such as a rigid thermoplastic, and may be made by any suitable method, such as machining or injection molding.

Figure 8B:
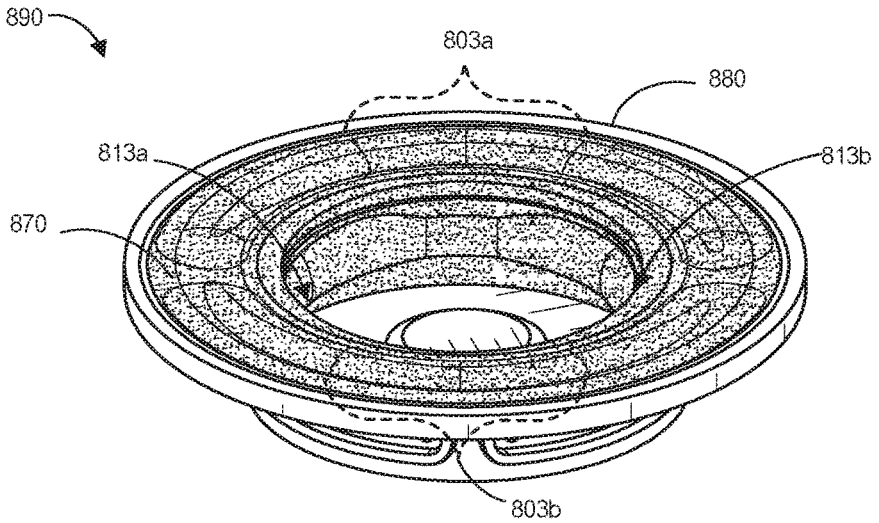
FIG. 8B illustrates the multi-pump sheet and the multi-pump substrate of FIG. 8A coupled together, in accordance with certain aspects.

FIG. 8B illustrates an example multi-pump 890 provided by coupling multi-pump sheet 870 and multi-pump substrate 880 together. In certain aspects, pump segments 803*a* and 803*b* are engaged by rollers of one roller head (e.g., roller head 903 of FIG. 9) while pump segments 813*a* and 813*b* are engaged by rollers of another roller head (e.g., roller head 203 of FIG. 9). In certain other aspects, pump segments 803*a*-803*b* and pump segments 813*a*-813*b* are engaged by different sets of rollers of the same roller head.

In certain aspects, coupling multi-pump sheet 870 and multi-pump substrate 880 provides two separate and independent pumps, each having two pump segments. For example, the first pump comprises pump segments 803*a* and 803*b* and the second pump comprises pump segments 813*a* and 813*b*. In certain aspects, the fluidic inlet and outlet associated with pump segments 813*a* and 813*b* are different than the fluidic inlet and outlet associated with pump segments 803*a* and 803*b*. In such aspects, for example, one fluid inlet of the cassette provides an inflow of fluids to the inlet ports associated with pump segments 813*a* and 813*b* while another fluid inlet of the cassette provides an inflow of fluids to the inlet ports associated with pump segments 803*a* and 803*b*. In such aspects, the first pump may be used for aspiration/suction while the second pump may be used for irrigation/infusion or vice versa.

In certain other aspects, the inlet/outlet ports as well as the fluidic inlet(s)/outlet(s) of the cassette may be configured such that bonding or attaching multi-pump sheet 870 and multi-pump substrate 880 provides a single pump with four pump segments 813*a* and 813*b* and 803*a* and 803*b*. In such aspects, the fluidic inlet and outlet associated with pump segments 813*a* and 813*b* are the same as the fluidic inlet and outlet associated with pump segments 803*a* and 803*b*. For example, the inlet ports associated with pump segments 813*a* and 813*b* and pump segments 803*a* and 803*b* are all connected to the same fluid inlet of the cassette. In such aspects, the pump may be used for aspiration/suction or irrigation/infusion.

Figure 8C:
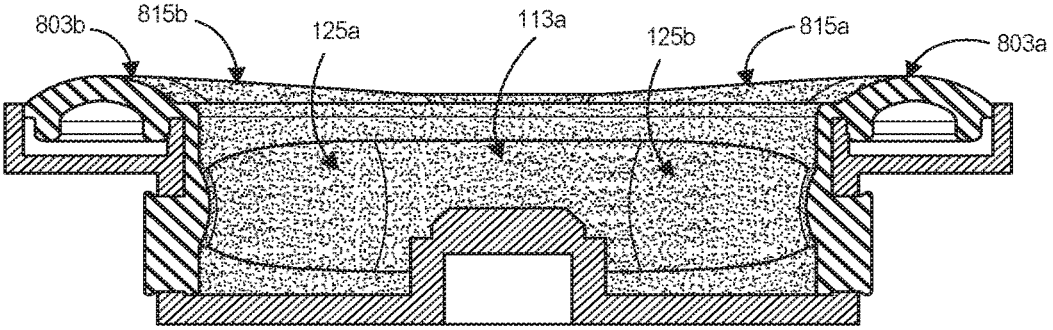
FIGS. 8C, 8D, and 8E illustrate different views of a multi-pump, in accordance with certain aspects.

FIG. 8C illustrates an example cross sectional view of the multi-pump 890 of FIG. 8B. FIG. 8C shows pump segments 803*a* and 803*b* as well as transition regions 815*a*-815*b* of the pump that is configure to be coplanar or parallel to the face of the cassette (e.g., "coplanar pump). FIG. 8C also shows segments transition regions 825*a*-825*b* and pump segment 813*a* of the pump that is configured to have an angle (e.g., 90 degrees) with the face of the cassette (e.g., non-coplanar pump).

Figure 8D:
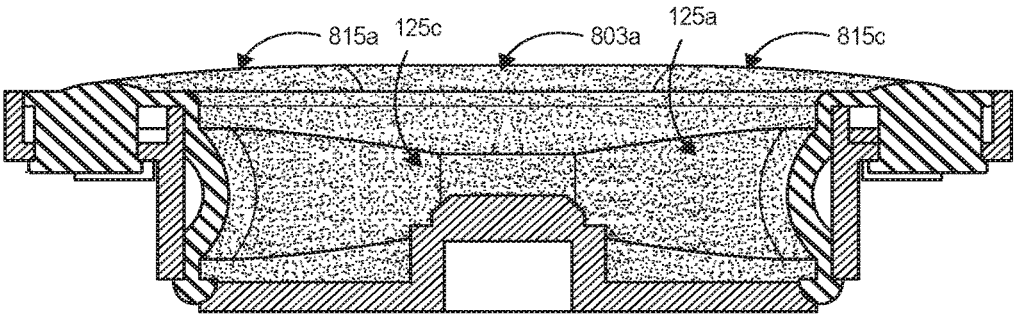

FIG. 8D illustrates another example cross sectional view of the multi-pump 890 of FIG. 8B but with a 90 degree rotation with respect to FIG. 8C. FIG. 8D shows transition regions 815*a*-815*c* and pump segment 803*a* of the coplanar pump. FIG. 8D also shows transition regions 825*c* and 825*a* of the non-coplanar pump.

Figure 8E:
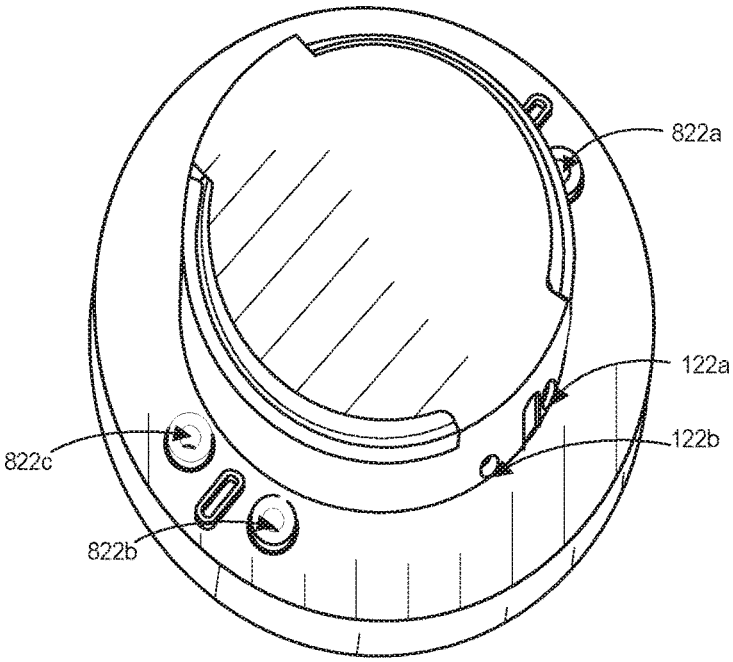

FIG. 8E illustrates a view of the bottom of multi-pump 890. As shown, multi-pump 890 comprises inlet/outlet ports 822*a*-822*c* (other ports are not shown) associated the coplanar pump and ports 822*a*-822*b* (822*c*-822*d* are not shown) associated with the non-coplanar pump.

Although FIGS. 8A-8D illustrate an example multi-pump cassette having a non-coplanar pump and a coplanar pump, in certain aspects, a multi-pump cassette may comprise two coplanar pumps. More specifically, a surgical cassette may comprise a face with two coplanar pumps placed thereon. In certain aspects, one of the coplanar pumps, referred to as the outer pump, may have larger pump segments and cover a larger surface area than the other coplanar pump, referred to as the inner pump surround. In such aspects, the outer pump surrounds the inner pump. In certain aspects, the two coplanar pumps are independent such that each pump is coupled to different fluidic inlets and outlets. In certain aspects, each of the coplanar pumps comprises one or more pump segments that operate similar to pump segments 803 shown in FIGS. 8A-8D. Further, each coplanar pump is operated with different sets of rollers, which may be part of the same roller head or different roller heads.

Figure 9:
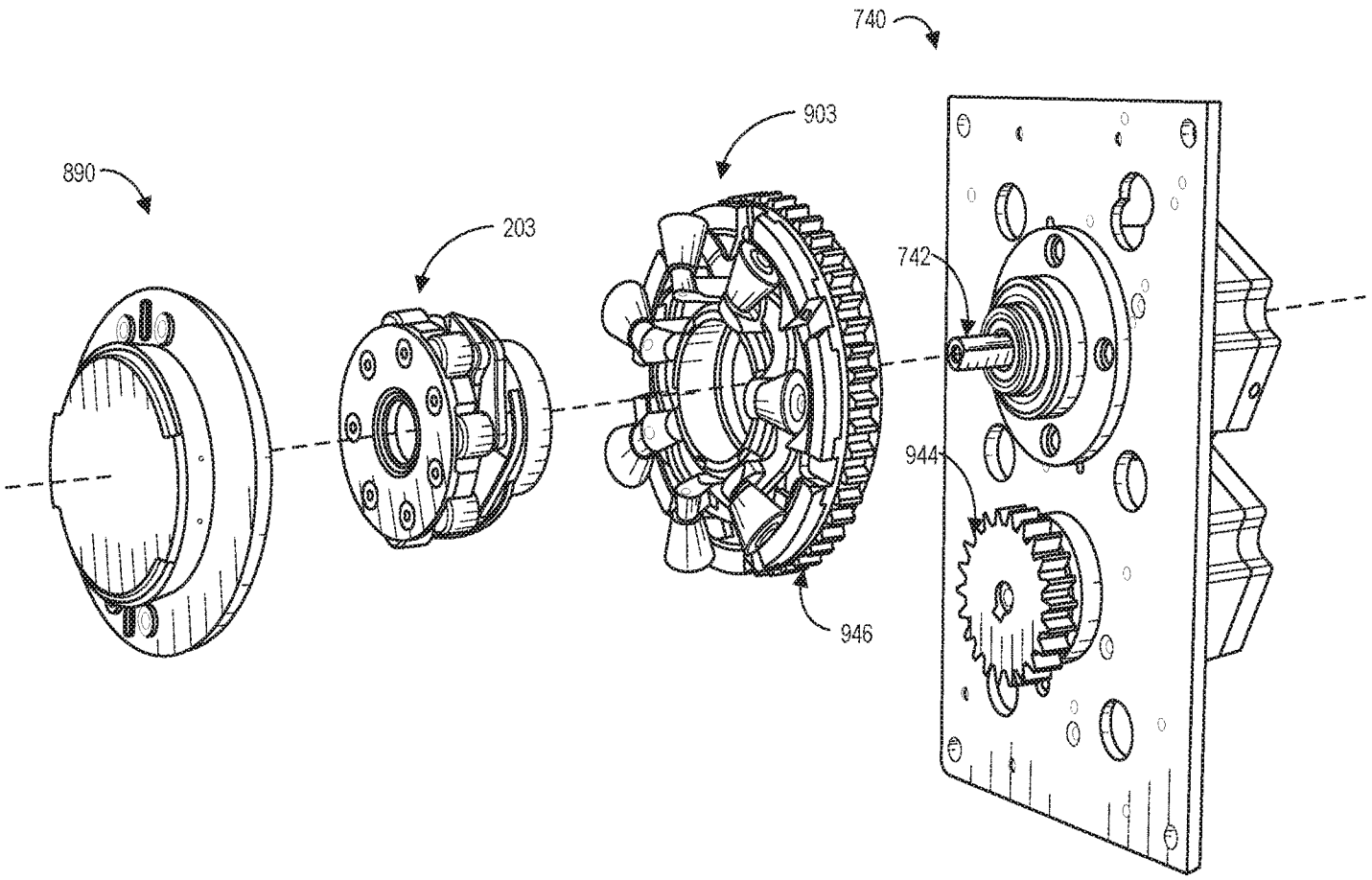
FIG. 9 illustrates two different roller heads configured to be coupled to assembly for engaging the multi-pump of FIGS. 8C, 8D, and 8E, in accordance with certain aspects.

FIG. 9 illustrates two different roller heads 203 and 903 that are configured to be coupled to assembly 740. Roller head 903 is configured to engage the coplanar pump of multi-pump 890 while roller head 203 is configured to engage the non-coplanar pump of multi-pump 890. As shown, roller head 903 is rotated using gear 944 of assembly 740. More specifically, gear 944 engages a gear 946 of roller head 903 to rotate roller head 903. Roller head 203, as described above, is rotated using shaft 742. In certain aspects, shaft 742 and gear 944 are operated or rotated by different motors (e.g., actuators), each of which may have a different motor speed (e.g., different rotation per second (RPS)). Although, in certain aspects, the same motor is used for rotating roller heads 203 and 903. Note that FIG. 9 only illustrates one example of how the coplanar and non-coplanar pumps may be engaged.

Figure 10A:
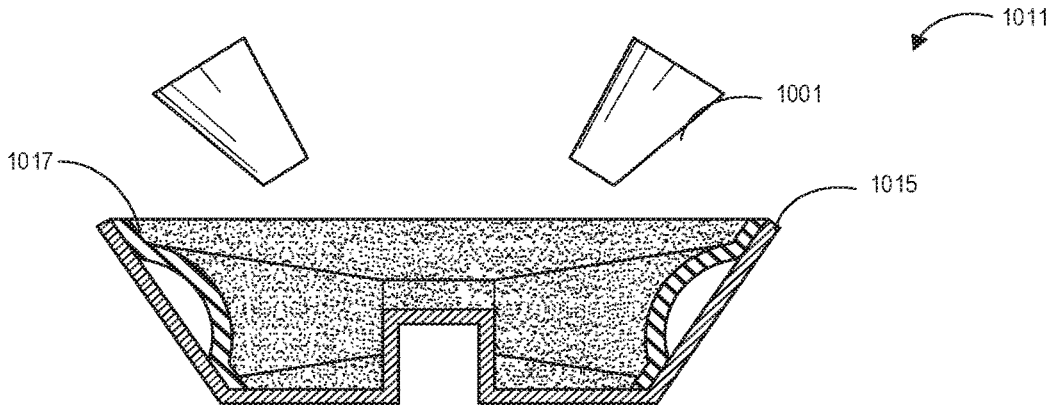
FIG. 10A illustrates a cross sectional view of an example non-coplanar pump, in accordance with certain aspects.

FIG. 10A illustrates a cross sectional view of another example non-coplanar pump 1011. Pump 1011 comprises substrate 1015 as well as sheet 1017, which are and operate similar to substrate 115 and sheet 117. Pump 1011 is engaged by one or more rollers of a roller head. For simplicity, only two rollers of the roller head are shown. As illustrated, the longitudinal axes of rollers 1011 are arranged such that rollers 1011 are able to contact pump 1011's segments generally parallel with the surface of the segments (e.g., parallel to the wall of pump 1011). The axis of rotation of rollers 1001 (or the corresponding roller head) makes an angle with substrate 1015 that is between 1-89 degrees (e.g., substrate 1015 and the axis of rotation of rollers 1011 are neither parallel nor perpendicular with respect to each other).

Figure 10B:
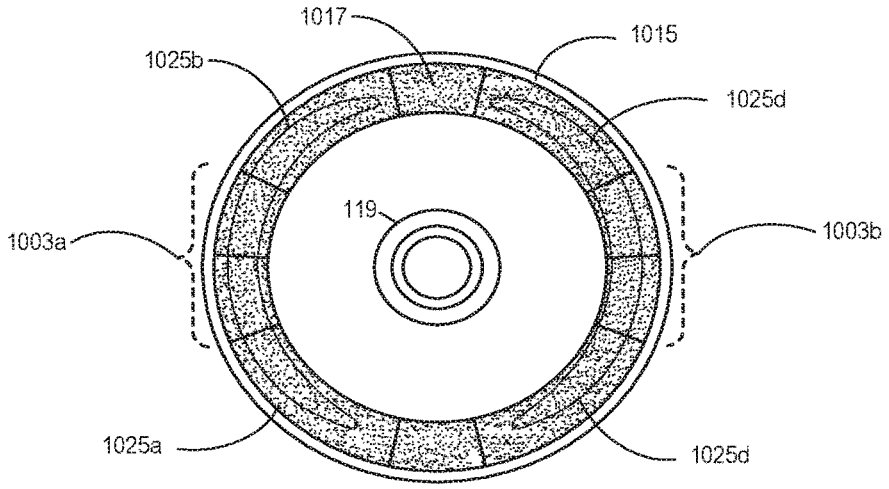
FIG. 10B illustrates a top view of the non-coplanar pump of FIG. 10A, in accordance with certain aspects.

FIG. 10B illustrates a top view of non-coplanar pump 1011 of FIG. 10A. As shown, pump 1011 comprises pump segments 1003*a*-*b* and transition regions 1025*a*-1025*d*. In certain aspects, pump 1011 is used in a cassette as the only pump. In certain aspects, pump 1011 is used in combination with another pump, such as a coplanar pump having pump segments such as pump segments 803 of the coplanar pump in FIG. 8*b*.

The foregoing description is provided to enable any person skilled in the art to practice the various embodiments described herein. Various modifications to these embodiments will be readily apparent to those skilled in the art, and the generic principles defined herein may be applied to other embodiments. Thus, the claims are not intended to be limited to the embodiments shown herein, but are to be accorded the full scope consistent with the language of the claims.

What is claimed is:

1. A surgical cassette configured to engage a first plurality of rollers of a first roller head, comprising:

a face coupled to a first pump substrate, the face being at a first angle with respect to an axis of rotation of the first roller head and a wall of the first pump substrate being at a second angle with respect to the axis of rotation of the first plurality of rollers, wherein the first angle is different from the second angle; and a first sheet positioned on a surface of the wall, wherein:

the first sheet and the wall form first one or more pump segments configured to engage the first plurality of rollers in a position where force applied by each one of the first plurality of rollers on the first one or more pump segments has a direction that is not parallel to the axis of rotation of the first roller head, and the wall comprises a first inlet aperture and a first outlet aperture; and a base having a plurality of inlet ports and a plurality of outlet ports, wherein the first pump substrate is rotatable relative to the base to: (i) selectively fluidically couple the first inlet aperture with one of the plurality of inlet ports and decouple the first inlet aperture from at least one other inlet port of the plurality of inlet ports, and simultaneously (ii) selectively fluidically couple the first outlet aperture with one of the plurality of outlet ports and decouple the first outlet aperture from at least one other outlet port of the plurality of outlet ports.

2. The surgical cassette of claim 1, wherein the wall is parallel to the axis of rotation of the first roller head.

3. The surgical cassette of claim 1, wherein:

the first pump substrate comprises an alignment guide that is configured to be inserted into an opening of the first roller head; and insertion of the alignment guide in the opening of the first roller head causes the first plurality of rollers to radially expand and exert force on the first one or more pump segments.

4. The surgical cassette of claim 1, wherein the first sheet comprises a front surface and a back surface, the front surface configured to contact the first plurality of rollers, the front surface having a convex profile, the back surface having a concave profile.

5. The surgical cassette of claim 4, wherein the wall further comprises a plurality of recessed channels, the plurality of recessed channels comprising active regions and transition channels, wherein the plurality of recessed channels are located adjacent to the back surface of the first sheet such that the concave profile of the back surface of the first sheet cooperates with the active regions to form the first one or more pump segments and further cooperates with the transition channels to form one or more transition regions.

6. The surgical cassette of claim 1, wherein rotating the first pump substrate relative to the base causes the first inlet aperture and the first outlet aperture to fluidically couple to different fluidic paths associated with different probes.

7. The surgical cassette of claim 1, wherein the first pump substrate comprises one or more notches configured to be engaged by an actuator for rotating the first pump substrate.

8. The surgical cassette of claim 1, wherein the base further comprises one or more latches for securing the first pump substrate in the surgical cassette.

* * * * *